United States Patent [19]

Canalizo et al.

[11] Patent Number: 4,545,731

[45] Date of Patent: Oct. 8, 1985

[54] METHOD AND APPARATUS FOR PRODUCING A WELL

[75] Inventors: Carlos R. Canalizo, Dallas; James M. Hays, Allen, both of Tex.

[73] Assignee: Otis Engineering Corporation, Dallas, Tex.

[21] Appl. No.: 576,854

[22] Filed: Feb. 3, 1984

[51] Int. Cl.[4] ..... F04B 23/14; F04F 1/08; F04F 1/20

[52] U.S. Cl. ..... 417/86; 417/90; 417/92; 417/111

[58] Field of Search ..... 417/86, 90, 92, 109, 417/111

[56] References Cited

U.S. PATENT DOCUMENTS

| | | | |
|---|---|---|---|
| 3,324,803 | 6/1967 | Kelley et al. | 417/86 |
| 3,814,545 | 6/1974 | Waters | 417/90 |
| 3,963,377 | 6/1976 | Elliott et al. | 417/90 |

OTHER PUBLICATIONS

Field Development Report OEC 5228, Otis Corporation, Dallas, TX, 1980.

Otis Safety Systems & Automatic Control Equipment, pp. 3504–3505.

*Primary Examiner*—Richard E. Gluck

*Attorney, Agent, or Firm*—H. Mathews Garland

[57] ABSTRACT

A system and method for producing earth formation fluids such as crude oil using a lighter oil to force the crude oil to the surface and thereafter removing the lighter oil by gas lift techniques. The well system includes spaced packers defining a production chamber in the well bore, a production tubing extending through the packers having check valves and ports for well fluids to flow into the chamber from below the packer while isolating the chamber from the pressure of production fluids in the production tubing. Power fluid tubing extends through the upper packer into the production chamber including spaced gas lift valves and gas flow means from the lowermost gas lift valve into the production chamber. Surface equipment is provided for pumping power fluid into the power fluid tubing string, introducing lift gas into the power fluid tubing string above the upper packer, and separating returned power fluid and lift gas. In the method, formation fluids flow into the production chamber under formation pressure, power fluid is pumped into the chamber displacing the formation fluids through the producing string, and the power fluid is removed from the production chamber and power fluid tubing by lift gas.

9 Claims, 7 Drawing Figures

METHOD AND APPARATUS FOR PRODUCING A WELL

This invention relates to a method and apparatus for producing a well and more particularly relates to an improvement in a method and apparatus for producing hydrocarbon fluids from an earth formation through a well wherein the hydrocarbon fluids flow into a chamber in the well under formation pressure, are displaced from the chamber through a production tubing by a lower density power fluid, and the power fluid is thereafter removed from the chamber using steps including lift gas techniques to empty the chamber.

It is known to produce hydrocarbon fluids through a well by displacing the fluids with a lower density power fluid and therafter removing the power fluid by conventional gas lift methods. Such a system is disclosed in U.S. Pat. No. 3,814,545 issued June 4, 1974 and in a publication of Otis Engineering Corporation dated August 1980 describing "Heavy-Crude Lift Systems". In the prior art systems described in such patent and publication hydrocarbon fluids, particularly heavy-crude oil, is permitted to flow under formation pressure into a production chamber in a well bore defined between spaced packers. The oil in the chamber is then displaced to the surface through a production tubing by a lower density power fluid pumped into the chamber through a separate power fluid tubing. Power fluid in the tubing is then gas lifted back to the surface face by introducing a gas under pressure into the well annulus above the upper packer and through gas lift valves spaced along the length of the power fluid tubing into the tubing where the lift gas mixes with the power fluid raising it back to the surface according to conventional gas lift procedure. As the power fluid is removed, production fluid again flows from the earth formation into the production chamber for a repetition of the production cycle. In this prior art system and method, the lowermost gas lift valve along the power fluid tubing is above the upper packer into which the lower end of the power fluid tubing connects. Thus the lift gas injected into the power fluid tubing is effective for lifting the power fluid only along the tubing above the upper packer. The power fluid below the upper packer in the production chamber of the well can only be displaced from the chamber upwardly into the power fluid tubing by the formation pressure acting on the hydrocarbon fluids flowing upwardly into the production chamber for repeat of the cycle. The well casing is several times larger than the power fluid tubing and thus as the formation fluids flow into the production chamber, the power fluid displaced from the chamber upwardly in the power fluid tubing must be lifted several times the height of the rise of the formation fluid coming into the chamber thereby presenting substantial back pressure on the inflowing formation fluids. For example where a two inch tubing is used for power fluid injection into a seven inch casing, the power fluid such as diesel oil must be displaced by the formation fluid upwardly in the power fluid tubing 10.7 feet for each one foot rise in the formation fluid flowing into the production chamber. There are therefore severe limitations due to this back pressure of the power fluid on the lengths of production chamber which may be employed in the prior art system and method. The inability of the lift gas to remove the power fluid from the power fluid tubing to a level no lower than the upper packer above the production chamber thus severely impairs the capabilities of the existing prior art method and system.

It is a principal object of the present invention to provide a new and improved method and apparatus for producing well fluids, particularly heavy oils, wherein the well fluids are forced from a well bore by a power fluid pumped into the well bore and the power fluid is thereafter gas lifted back to the surface.

It is another object of the invention to provide a new and improved method and system for producing well fluids wherein the well fluids flow into a defined production chamber in the well bore, are pumped from the well bore by a power fluid introduced into the production chamber, and the power fluid is thereafter essentially all removed from the production chamber by a displacing lift gas.

It is another object of the invention to provide a method and apparatus of the character described wherein lift gas is introduced through the lowermost of gas lift valves secured along the power fluid tubing and such lift gas is flowed downwardly in a dip tube and discharged near the lower end of the production chamber to displace essentially all of the power fluid from the production chamber.

It is another object of the invention to provide a method and apparatus as described wherein power fluid is displaced from the production chamber through a dip tube by gas introduced into the upper end of the production chamber.

It is another object of the invention to provide a method and apparatus for producing a well wherein heavy crude oil is produced into a production chamber in the well between two packers by formation pressure, the heavy crude oil is displaced from the production chamber through a production tubing string by a power fluid comprising an oil of less density than the heavy crude oil, and the power fluid is then removed from the production chamber through a power fluid tubing string by lift gas introduced sequentially through gas lift valves along the length of the power fluid tubing string until the lift gas enters the production chamber displacing essentially all of the power fluid to the surface, the flow of lift gas is terminated into the production chamber, the power fluid tubing string is vented to reduce the pressure in the production chamber to essentially atmospheric, and production fluid is again admitted under formation pressure into the production chamber for another production cycle.

It is another object of the invention to provide an improved method and system for producing a well by flowing formation fluids into a chamber in the well bore under formation pressure, displacing the fluids from the production chamber using a power fluid of less density than the well fluids, and removing the power fluid from the production chamber by gas lift wherein substantially greater amount of the power fluid is removed than in prior art methods and systems.

It is a further object of the invention to provide a new and improved method and system for producing well fluids of the character described wherein only a minimum quantity of power fluid remains in the production chamber after the producing step which must thereafter be lifted by incoming production fluids in the next production cycle.

In accordance with the invention, a method and apparatus are provided for producing well fluids wherein well fluids flow under formation pressure into a defined production chamber in the well bore, are displaced from the production chamber through a producing tubing string by power fluid pumped into the production chamber, and the power fluid is removed to the surface using injected gas. The well system for carrying out the method includes a well extending to the producing formation, a lower packer set in the well above the producing formation, an upper packer set in the well spaced above the lower packer defining therebetween a production chamber, a production tubing string extending from the surface through the packers opening at the lower end below the lower packer, perforations in the production tubing string above the lower packer near the lower end of the production chamber, a first check valve in the production tubing string below the perforations, a second check valve in the production tubing string above the perforations, a power fluid tubing string from the surface to the upper packer opening at a lower end through the upper packer into the production chamber, a plurality of gas lift valves secured in spaced relation along the power fluid tubing string, the well wall around the production tubing string and power fluid tubing string above the upper packer defining a lift gas chamber, and means connected with the lowermost gas lift valve for directing lift gas into the production chamber to displace the power fluid from the chamber into the power fluid tubing string. The method of the invention includes the steps of flowing production fluids from the well formation into the well bore below the lower packer and upwardly through the first check valve and production tubing string perforations into the production chamber under formation pressure until the production chamber is substantially filled, pumping power fluid through the power fluid tubing string into the production chamber displacing the production fluids from the production chamber through the perforations in the production tubing string and upwardly in the production tubing string through the second check valve until the production chamber is substantially filled with power fluid and the production fluids are substantially displaced from the production chamber, flowing lift gas into the lift gas chamber and through the gas lift valves into the power fluid tubing string until lift gas enters the production chamber through the lowermost gas lift valve the flow continuing until the lift gas has displaced substantially all of the power fluid from the production chamber and power fluid tubing string, stopping the flow of lift gas into the lift gas chamber, venting the power fluid tubing string to reduce the pressure in the production chamber to substantially atmospheric, and again flowing production fluids into the production chamber from below the lower packer until the production chamber is substantially refilled to repeat the production cycle.

The foregoing objects and advantages of the present invention will be better understood from the following detailed description of specific embodiments thereof taken in conjunction with the accompanying drawings wherein.

Figures 1, 5, 6:
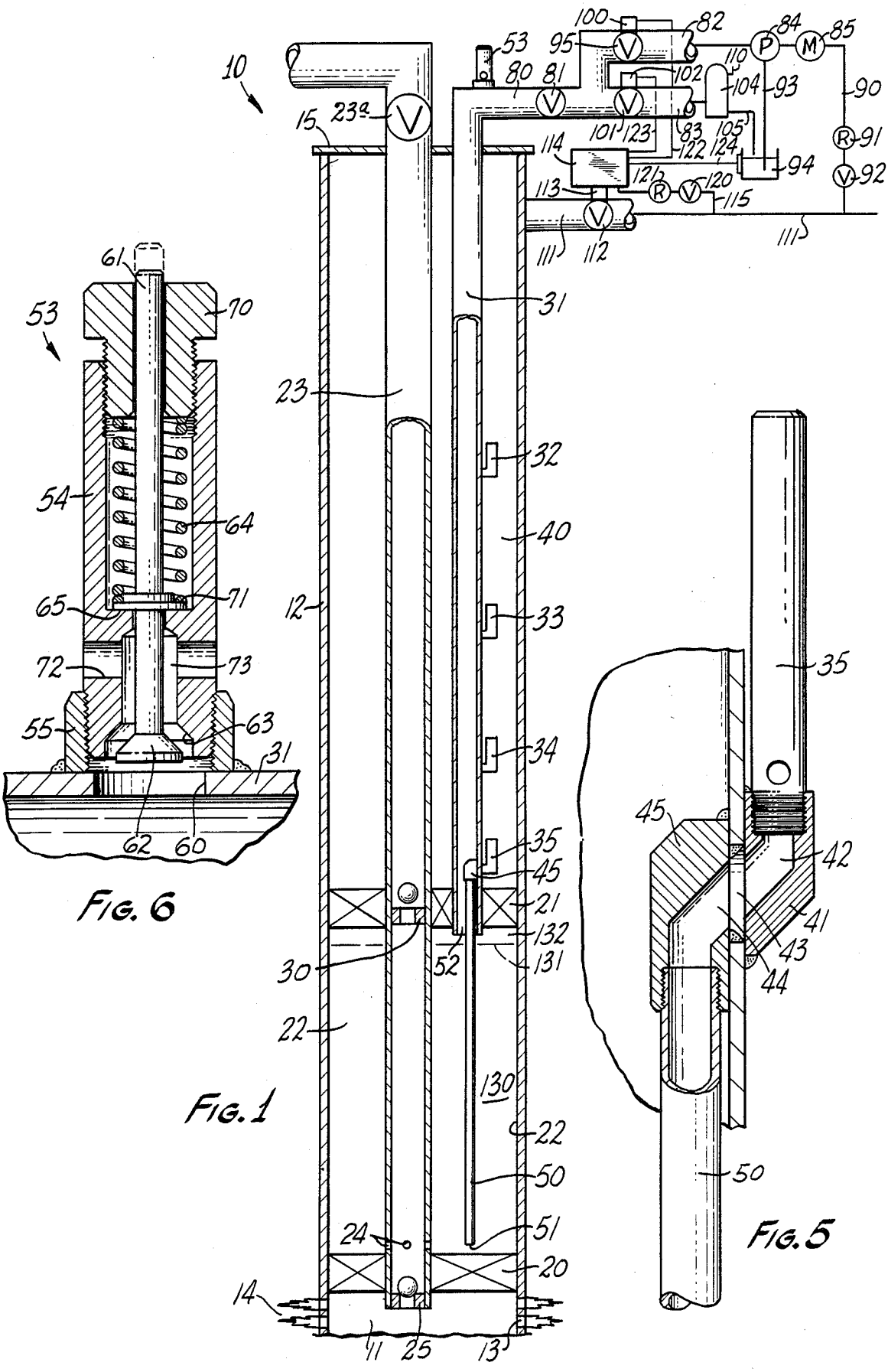
FIG. 1 is a schematic view in section and elevation showing well and surface apparatus comprising the system of the invention and illustrating the method of the invention at the initiation of the first step of displacing an essentially full production chamber by pumping power fluid into the chamber.
FIG. 5 is an enlarged fragmentary view in section and elevation showing the lowermost gas lift valve and the connection of the upper end of the dip tube into the power fluid tubing string and lowermost gas lift valve.
FIG. 6 is an enlarged fragmentary view in section of the vent valve connected into the power fluid tubing string showing the valve in open venting mode.

Referring to FIG. 1, a well producing system 10 embodying the features of the invention includes a well bore 11 lined with a casing 12 perforated at 13 to admit well fluids to the well bore through the casing from a producing formation 14. The casing extends to a wellhead 15 at the surface end of the well bore. A lower single packer 20 is set in the casing above the perforations 13. An upper dual packer 21 is set in the casing spaced above the lower packer defining a production chamber 22 within the casing between the lower and upper packers. A string of production tubing 23 including a flow control valve **23*a* extends from the wellhead downwardly in the casing through the upper and lower packers. The lower end of the production tubing string opens below the lower packer for formation fluid flow from the well bore below the lower packer into the lower end of the production tubing string. A plurality of perforations 24 are provided in the production tubing string above the lower packer near the lower end of the production chamber 22. A first check valve 25 is mounted in the production tubing string between the lower end of the string and the perforations 24 to permit formation fluid flow upwardly into the production tubing string while preventing downward flow from the tubing string into the well below the lower packer. A second check valve 30 is installed in the production tubing string above the perforations 24 to permit upward flow in the production tubing string while precluding downward flow in the tubing string from above the second check valve. A power fluid tubing string 31 is connected through the wellhead downwardly in the well bore through the upper packer 21 opening at the lower end thereof into the upper end portion of the production chamber 22. A plurality of gas lift valves 32, 33, 34 and 35 are secured in spaced relation along the length of the power fluid tubing string 31. The inner wall of the casing 12 between the upper packer 21 and the wellhead 15 is a well annulus defining a gas lift chamber 40 for flow of lift gas in the casing to the gas lift valves 32–35. Referring to both FIGS. 1 and 5, the lowermost gas lift valve 35 is secured into a nipple 41 mounted along the side of the power fluid tubing string 31 and has a flow passage 42 opening to a port 43 in the tubing string. The port 43 communicates with a flow passage 44 in an internal nipple 45 secured within the bore of the tubing string 31. A dip tube 50 is secured at an upper end into the nipple 45 and extends vertically downwardly in the production chamber 22. The bore of the dip tube opens at the upper end into the flow passage 44 of the nipple 45 and at the lower end 51 into the production chamber 22 spaced above the lower packer 20. The lower end 51 of the dip tube is preferably near the lower end of the production chamber 22 while being spaced sufficiently up the chamber from the lower packer 20 permit normal sediment accumulation in the lower end of the chamber without plugging the dip tube opening. It is necessary at all times during the operation of the system that the lower end of the dip tube be open for maximum lift gas flow into the chamber 22. The upper end portion of the dip tube as well as the nipple 45 supporting the dip tube are sufficiently smaller than the bore of the power fluid tubing 31 at the lower open end 52 of the power tubing to allow ample flow space for power fluid which is pumped into the chamber 22 and gas lifted out of the chamber through the open lower end of the power fluid tubing around the nipple 45 and upper end portion of the dip tube. A vent valve 53 is mounted on the power fluid tubing string 31 above the wellhead 15 to vent the bore of the tubing string to the atmosphere. Referring to FIG. 6, the vent valve 53 includes a tubular body 54 connected at a lower end into a nipple 55 welded on the power fluid tubing string 31 opening into the tubing string through a vent valve port 60. The vent valve has a stem 61 provided at the lower end with a valve 62 engageable with an internal annular seat 63 in the valve body to close the bore through the valve. In FIG. 6 the valve is shown in its normal open position. The valve is biased open by a coil spring 64 compressed within the bore of the body 54 between a flange 65 on the valve stem and the lower end of a cap 70 screwed into the upper end of the body. A stop shoulder 71 formed in the body limits the downward movement of the stop flange 65 on the valve stem. Side ports 72 in the valve body communicate with the bore 73 of the body around the valve stem and past the valve seat 63 and valve 62 into the tubing 31 through the port 60 for venting the power fluid tubing string to the atmosphere. A predetermined higher pressure within the tubing string 31 moves the valve 62 and stem 61 upwardly compressing the spring 64 closing the valve when the valve 62 engages the seat 63**. The valve operates in response to the pressure changes in the power fluid tubing string closing during injection of power fluid and lift gas and opening when the flow of lift gas is terminated to vent the production chamber and power fluid tubing string.

Surface apparatus which may be used to operate the system and method of the invention for pumping the power fluid into the well bore and removing the power fluid with lift gas is illustrated in FIG. 1. A flow line 80 including a master valve 81 is connected at the wellhead 15 with the power fluid tubing string 31 to supply and remove power fluid. A power fluid supply line 82 and a return line 83 are connected with the line 80. The supply line 82 is connected with a pump 84 driven by a motor 85 which may be any one of a variety of prime movers such as a gas engine connected with a supply gas line 90 for gas provided through a regulator 91 and a control valve 92. The pump 84 has an intake line 93 leading to a power fluid reservoir 94. A motor valve 95 controlled by a valve operator 100 is connected in the power fluid supply line 82 for controlling flow of power fluid to the tubing string 31. The return line 83 also includes a motor valve 101 having a valve operator 102. The return line 83 connects into an oil and gas separator 104 which has an oil return line 105 leading to the reservoir 94 and a vent line 110 for venting separated gas to the atmosphere. The vent line 110 may if desired be connected with means, not shown, for returning the separated gas back into the lift gas supply for the well system. The separator 104 may be any available oil and gas separator which will process the returned mixture of power fluid and lift gas to separate the power fluid from the lift gas returning the power fluid to the reservoir 94 for reuse in a succeeding production cycle of the system. The separated lift gas may of course be either vented to the atmosphere or as previously stated returned to the lift gas supply for reuse.

Lift gas for removing the power fluid from the system is supplied to the lift gas chamber 40 between the upper packer 21 and the wellhead 15 through a supply line 111 leading from a suitable supply source, not shown, of a gas which could be air or a natural gas at a suitable pressure. The lift gas system may include a compressor, not shown, as illustrated in U.S. Pat. No. 3,814,545. A motor valve 112 including an operator 113 is connected in the lift gas supply line 111 to control the supply outlift gas to the chamber 40. A gas operated motor valve controller 114 including a timing system is connected by line 115 with the lift gas supply line 111. The line 115 includes the valve 120 and a pressure regulator 121. The motor valve controller 114 may be an available gas operated controller such as an Otis Hi-Torc Automatic Controller as shown at pages 3556 and 3557 of the 1972–73 edition of the Composite Catalog of Oilfield Equipment and Services published by World Oil, Houston, Tex. The controller performs multiple timing and motor valve operator functions opening and closing the motor valves 100, 102, and 112. The controller is connected with the valves 100 and 102 by gas lines 122 and 123 respectively. The controller is connected with the valve 112 by a similar gas line, not shown. The controller is connected with the reservoir 94 by a line 124 so that the operation of the controller may respond to high and low levels of power fluid in the reservoir 94 if desired. The controller operates in a conventional manner opening and closing the controlled motor valves in accordance with a predetermined timing schedule programmed into the controller to provide the desired timing of the flow to and from the well of the power fluid, the lift gas, and the returning power fluid and lift gas mixture.

Figure 2:
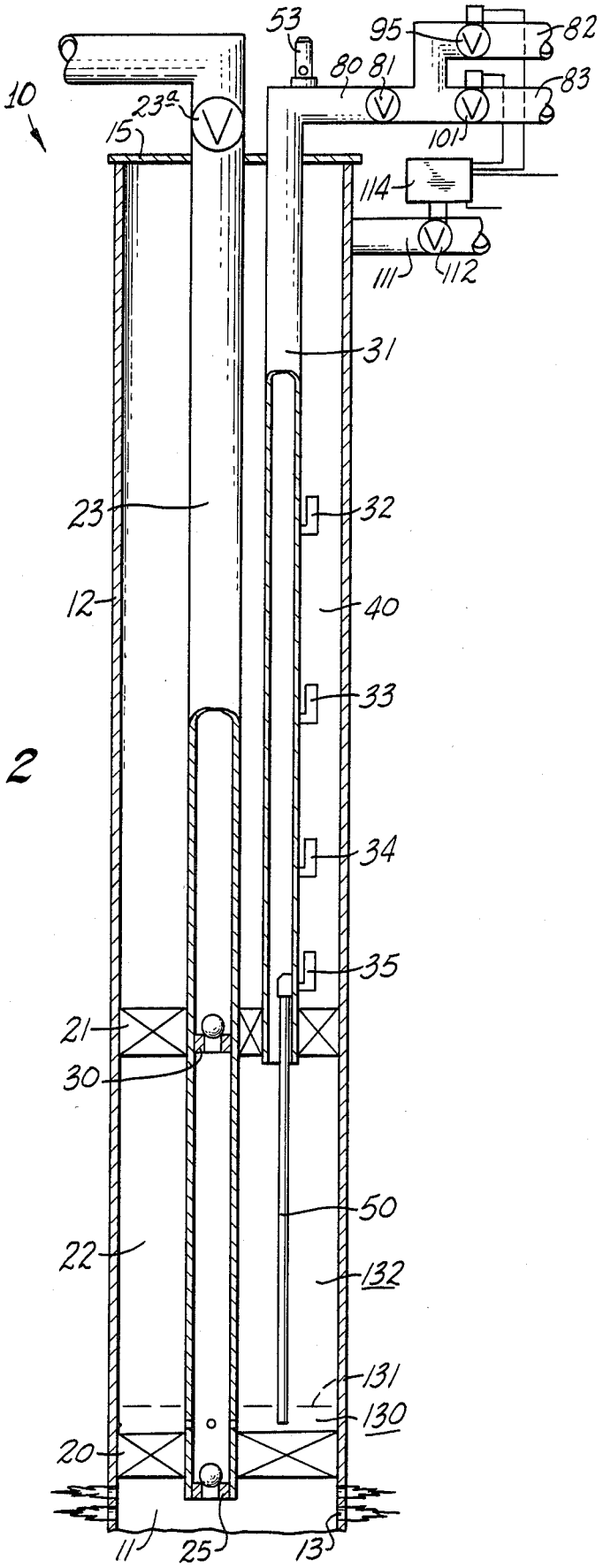
FIG. 2 is a schematic view similar to FIG. 1 illustrating the completion of the first step of pumping the production fluid out of the production chamber with the power fluid.

The sequence of steps forming the method of producing a well with the apparatus illustrated and described is shown in FIGS. 1–4. FIG. 1 represents the method at the point in time when formation fluids such as heavy crude have flowed under formation pressure into the production chamber 22 between the packers 20 and 21 essentially filling the chamber. As will be understood more fully from the description of the method, the formation fluids flow into the chamber 22 against essentially only atmospheric pressure in contrast with the fluid head pressure of a long column of power fluid in the prior art. The formation fluids from the formation 14 flowing under natural formation pressure pass through the perforations 13 of the casing 12 into the well bore 11 below the lower packer 20. The fluids then flow upwardly through the check valve 25 into the lower end portion of the production tubing string 23 and outwardly through the side ports 24 into the annular production chamber 22. Any production fluid from a previous production cycle in the tubing string 23 above the check valve 30 is supported in the tubing string by the check valve which is closed and thus the inflow of production fluid into the chamber 22 does not have to flow against the pressure of the column of production fluid in the tubing string 23. It will be recognized that the formation fluids will flow into the chamber 22 so long as the formation pressure forcing the fluid into the chamber exceeds the back pressure of the column of fluid within the chamber. One of the criteria of course applied in designing the length of the chamber is the formation pressure available for displacing the fluid into the chamber. Presuming the availability of sufficient lift gas pressure to remove power fluid from the system, the chamber 22 would be designed with a length at least equal to the height to which the formation pressure would fill the chamber. In one particular example with a bottom hole pressure of 500 psi, the formation pressure would fill 1152 feet in the chamber 22 holding 37.8 barrels of fluid in a 7 inch casing. Thus after the chamber 22 is essentially filled with formation fluid as described, the formation fluid being identified by the reference numeral 130 in FIG. 1 below the line 131, the step of displacing the formation fluid with power fluid begins. In FIG. 1 the power fluid is represented by reference numeral 132 shown in the chamber 22 above the innerface line 131 between the production fluid and the power fluid. Typically where the production fluid is heavy crude oil the power fluid is a diesel oil of less density. The power fluid is pumped into the tubing string 31 through the open valves 95 and 81 in the line 82 by the pump 84 the intake of which pulls the power fluid from the reservoir 94. The power fluid flows downwardly in the tubing string 31 and outwardly through the lower open end 52 of the tubing string into the production chamber 22 above the body of the formation fluid 130. The power fluid flows into the chamber above the formation fluid and forcing the formation fluid downwardly into the production tubing string ports 24 and upwardly in the tubing string 23 through the check valve 30 to the wellhead at the surface. The pressure applied by the power fluid sufficiently exceeds the formation pressure to keep the check valve 25 closed. The power fluid is pumped into the chamber 22 until the chamber is essentially empty of formation fluid as represented in FIG. 2. The time during which the control valve 95 in the power fluid supply line 82 is open as determined by the timing setting of the controller 114 is set in accordance with the time required to pump a sufficient quantity of power fluid into the chamber to essentially empty the chamber.

When the production chamber 22 is essentially full of pumped in power fluid and the formation fluids have thereby been displaced from the chamber through the production tubing 23, the controller 114 closes the valve 95 shutting off the flow of power fluid to the production chamber. During the step of displacing the formation fluid with the power fluid the pressure in the chamber 22 exceeds the formation pressure so that the check valve 25 in the lower end of the production tubing remains closed. When the pumping of the power fluid into the chamber ceases the column of formation fluid in the tubing string 23 above the upper check valve 30 closes the check valve. FIG. 2 shows a small quantity of formation fluid 130 remaining in the chamber 22 at the termination of pumping the power fluid and into the chamber. To avoid pumping power fluid up the production string 23 the amount of power fluid pumped in is desirably measured to leave the relatively small quantity represented in FIG. 2 in the lower end of the chamber at the completion of the step of pumping in the power fluid.

Figure 3:
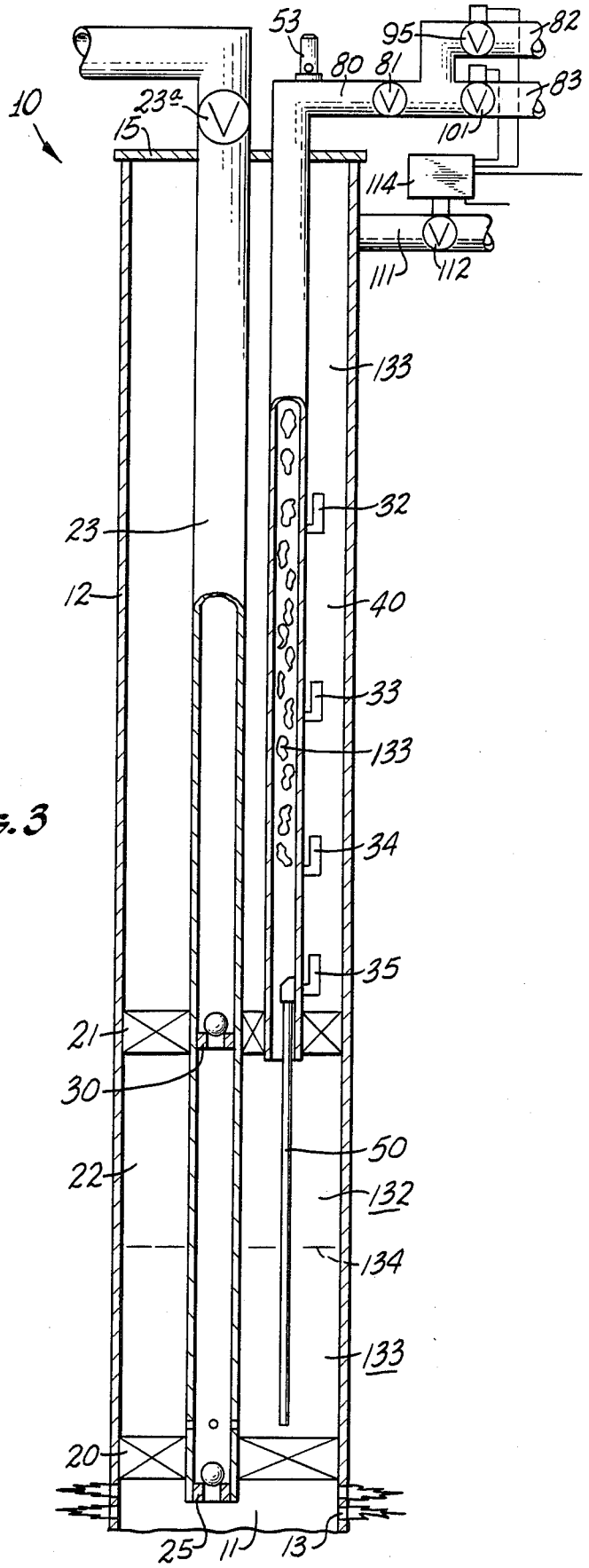
FIG. 3 is a schematic view similar to FIGS. 1 and 2 illustrating an intermediate stage in the step of removing the power fluid by injected lift gas.

After the pump 84 is shut down and the valve 95 closed terminating the pumping in of the power fluid, the step of removing the power fluid with lift gas begins, an interim stage in such step being represented in FIG. 3. The controller 114 opens the valve 101 in the return line 83 leading to the separator 104 and the valve 112 in the lift gas supply line 111. Lift gas which may be natural gas or air flows into the lift gas chamber 40 between the upper packer 21 and the well head 15 through the supply line 111. The gas is admitted into the well annulus chamber 40 at a sufficient pressure calculated to displace the power fluid from the chamber 22 and the tubing string 31. According to known gas lift techniques, the gas lift valves 32–35 inclusive are set at graduated opening pressures with the valve 32 having the highest opening pressure and the valve 35 the lowest. For example the valves typically might be set with the following opening pressures: valve 32—800 psi; valve 33—775 psi; valve 34—750 psi; and valve 35—700 psi. Thus when the lift gas pressure in the chamber 40 reaches 800 psi all of the gas lift valves open though the pressure gradient in the power fluid tubing string precludes all of the valves initially passing lift gas. Lift gas injection into the tubing string 31 begins in the top gas lift valve 32 admitting the gas into the tubing string 31 where it mixes with the power fluid to lighten the column of fluid above the valve 32 and push the column upwardly in the tubing string 31 and outwardly through the line 80, valve 81, valve 101, and line 83 into the separator 104. The injection gas pressure in the chamber 40 decreases as the gas flows through the gas lift valve 32 to a level below 800 psi permitting the gas lift valve 32 to close. The normal design of a gas lift system positions the second gas lift valve 33 at a distance below the valve 32 which causes the valve 33 to begin to pass lift gas into the tubing string 31 before the closure of the gas lift valve 32 so that there is some overlap between the operation of the top gas lift valve and the second gas lift valve down the tubing string. The lift gas aerates the power fluid and with some piston effect pushes the column of power fluid above the second gas lift valve 33 upwardly through the tubing string 31 and outwardly into the separator 104 until the gas lift pressure decreases below 775 psi when the valve 33 closes. The valve 34 begins to pass lift gas shortly before the closure of the valve 33. The gas lift valves 34 and 35 may be spaced and designed to function simultaneously during the latter phases of removing the power fluid from the chamber 22 and tubing string 31. The bottom gas lift valve 35 is sized to dump the lift gas rapidly downwardly through the dip tube into the production chamber 22 at the same time that the gas lift valve 34 is continuing to admit lift gas into the tubing string 31. The valve 34 may be a continuous flow or aeration type valve to admit lift gas without producing a back pressure acting against the gas admitted to the production chamber through the bottom valve 35 which may be a large ported intermitting valve for a large volume rapid gas flow The rapid flow of lift gas through the dip tube and outwardly at the bottom end of the dip tube into the lower portion of the chamber 22 creates a piston-like or slug effect in the power fluid within the chamber 22 lifting the power fluid rather than aerating and lightening to force the power fluid upwardly into the lower end of the tubing string 31 around the upper end portion of the dip tube 50 and the nipple 45 into the tubing string. The column of power fluid being forced upwardly in the tubing 31 is aerated as the fluid passes the gas lift valve 34 which continues to admit lift gas while the gas lift valve 35 is dumping gas into the chamber 22 through the dip tube. Essentially all of the power fluid is displaced from the chamber 22 and gas lifted through the tubing string 31 into the separator 104. In the separator the liquid is separated from the gas and directed through the line 105 to the reservoir 94 for recirculating back to the production chamber in the next production cycle. The separated lift gas passes out through the vent 110 to the atmosphere or, alternatively, may be returned if desired to the source of lift gas through a vent line, not shown, from the separator. While the major portion of the power fluid is removed from the chamber 22 and the tubing string 31 by the combined functions of gas lifting through the valves 32, 33 and 34 and the rapid dumping of gas into the chamber 22 through the valve 35, a small quantity of power fluid may remain in the chamber due to slippage. The amount of power fluid remaining in the chamber additionally is a function of how far the lower end 51 of the dip tube 50 is from the bottom of the chamber 22.

During removal of the power fluid from the production chamber 22, the pressure of the formation fluids in the tubing string 23 is sufficient to prevent the gas in the chamber 22 from flowing into the production tubing string. Also the pressure of the gas in the chamber 22 is sufficient to keep formation fluids from flowing into the chamber through the check valve 25.

Figure 4:
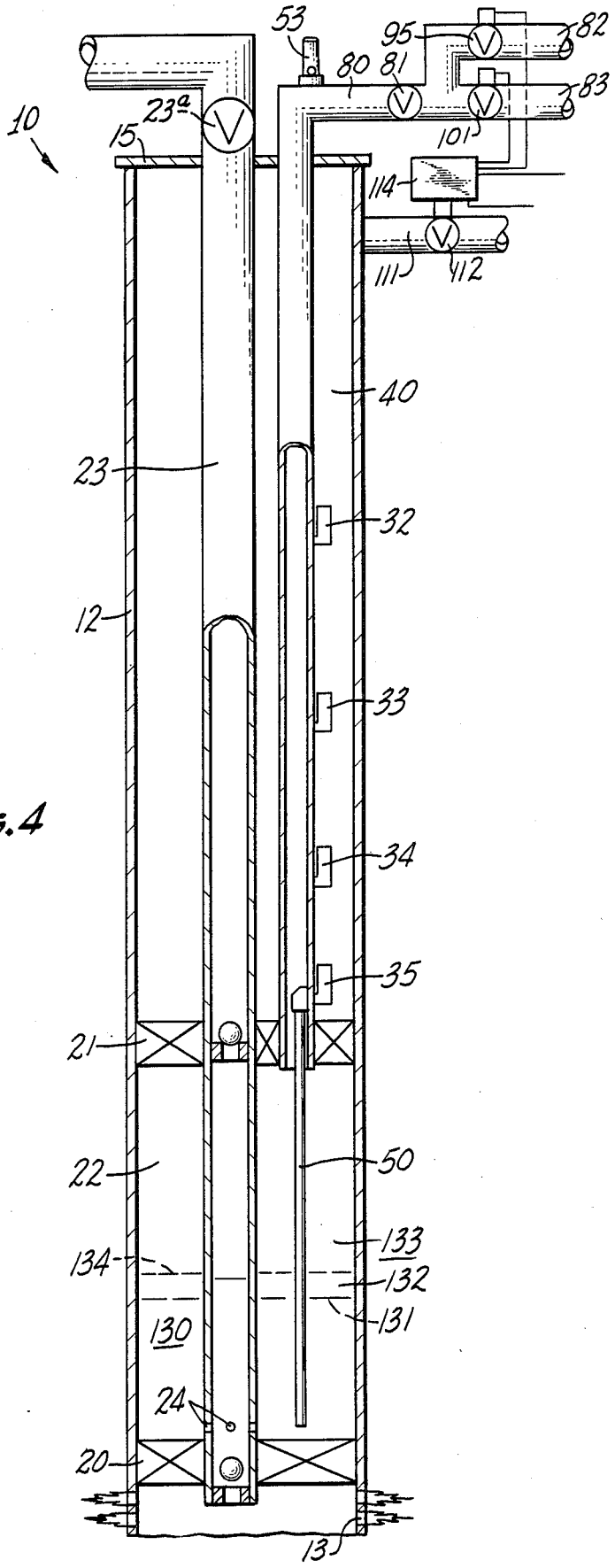
FIG. 4 is a schematic view similar to FIGS. 1–3 illustrating an intermediate stage in the step of refilling the production chamber with production fluids after removal of the power fluid by the lift gas.

When the step of removing the power fluid is complete, the flow of lift gas through the line 111 is shut off by closing the valve 112. Closure of the valve 112 by the controller 114 may be set on a time basis calculated for the admission of a specific volume of lift gas for complete removal of the power fluid from the system. Another control of the valve 112 may respond to a high fluid level in the reservoir 94 indicating a return of a specific volume of power fluid from the well. When the injection gas flow is shut off, the reduced pressure in the line 80 leading to the tubing string 31 permits the vent valve 53 to open. Referring to FIG. 6, a reduced pressure sensed through the port 60 allows the spring 64 to move the valve member 62 downwardly opening the valve as illustrated. The valve 53 thus vents the tubing string 31 to the atmosphere through the side ports 72 in the valve body. The opening of the vent valve effects essentially atmospheric pressure in the production chamber 22 so that there is little back pressure against the flow of formation fluids into the chamber. FIG. 4 represents an intermediate stage in the step of refilling the chamber 22 with formation fluids which flow from the producing formation through the ports 13 into the well bore 11 and upwardly through the check valve 25 and the ports 24 into the chamber 22. FIG. 4 illustrates an interim stage in the refilling of the production chamber 22 with formation fluids. As shown, the formation fluids 130 are rising in the chamber and a layer of the residual power fluid 132 floats on the top surface of the formation fluids below the injection gas 133 which is at substantially atmospheric pressure and being displaced as the chamber refills with formation fluid. In FIG. 4 the line 134 represents the interface between the layer of power fluid 132 and the remaining lift gas 133. The formation fluids continue to flow into the chamber 22 until the chamber is essentially full as represented in FIG. 1 at which time the controller 114 reopens the valve 95 and starts the pump 84 to begin the next production cycle by pumping the power fluid into the chamber 22 through the tubing string 31 as previously described. Thus the method of invention comprises the repetitive sequence of the steps of formation fluids flowing into the chamber 22, the power fluid being pumped into the chamber to produce the formation fluids from the chamber, and the removal of the power fluid from the chamber and the power fluid tubing string 31 using gas lift procedures. The gas lift procedures include both the steps of gas lifting the power fluid in the tubing string 31 as well as using the piston-like or slug effect to displace the power fluid from the chamber with lift gas introduced into the gas lift valve 35 and downwardly to the lower end portion of the chamber through the dip tube 50.

Figure 7:
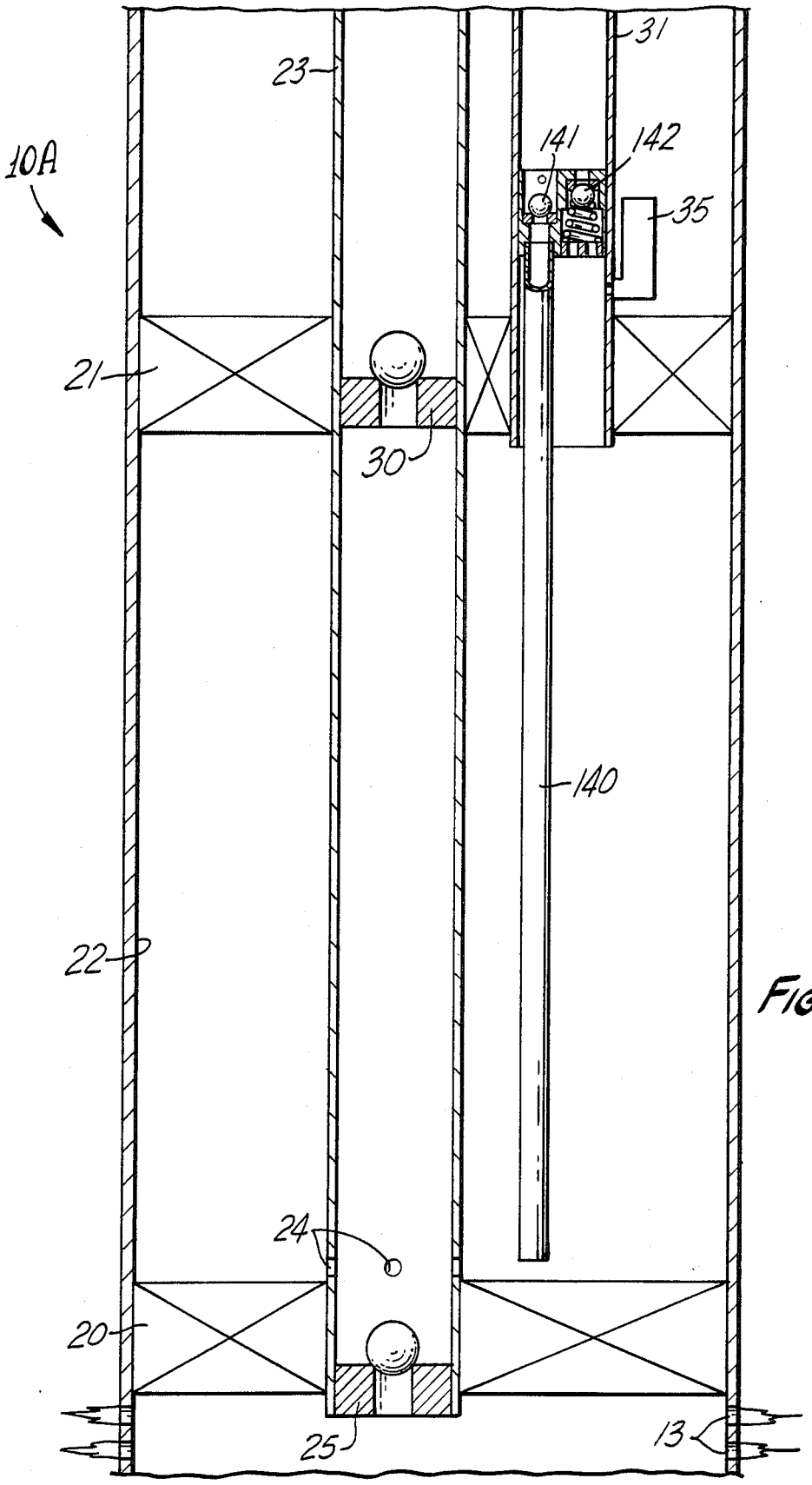
FIG. 7 is a fragmentary view in section of an alternate structure for introducing gas into the production chamber to remove power fluid.

Referring to FIG. 7, an alternate well production system 10A embodying the features of the invention includes structure identical to that described and illustrated in FIG. 1 other than the apparatus for introducing gas into the production chamber 22 for removing the power fluid from the chamber through the well tubing string 31. In the embodiment of FIG. 7 the power fluid is displaced from the production chamber by introducing the lift gas into the upper end of the chamber rather than the lower end of the chamber and displacing the power fluid by a U-tube effect into the tubing string 31. A dip tube 140 is supported along an upper portion opening into the tubing string 31 at the upper end thereof and terminates and opens at a lower end near the lower end of the chamber 22. The dip tube 140 has a check valve 141 in the upper end portion of the tube permitting upward flow in the dip tube into the tubing string 31 while precluding downward flow through the dip tube. The upper end portion of the dip tube is mounted in concentric spaced relation within the lower end portion of the tubing string 31 to provide an annular discharge from the tubing string 31 around the dip tube into the upper end of the production chamber 22. One or more check valves 142 are secured between the upper end portion of the dip tube 140 and the tubing string 31 to permit downward flow of power fluid from the tubing string 31 into the upper end of the production chamber 22 and preclude upward flow from the production chamber into the tubing string 31 around the dip tube. Other features of the production system 10A including the production tubing string 23 extending through the upper and lower packers 21 and 20 as well as the lower and upper check valves 25 and 30 in the production tubing string are arranged in the system in the same relationship illustrated and described with respect to FIG. 1.

The method of the invention carried out in the alternate production system 10A is identical to the method practiced in the system 10 with the exception of the steps employed to remove the power fluid from the production chamber 22 after the power fluid has displaced the production fluid into the tubing string 23. When the production chamber 22 is filled with formation fluids in the manner previously described, the power fluid is then pumped downwardly through the tubing string 31 through the check valve 142 at the lower end of the tubing string into the upper end of the production chamber 22 around the dip tube 140. The power fluid forces the formation production fluids into the tubing string 23 through the ports 24 as previously described. When the production chamber is essentially emptied of formation fluids and filled with power fluid, lift gas is then introduced into the tubing string 31 following the steps previously discussed. When the power fluid in the tubing string 31 is gas lifted to the stage at which the valves 34 and 35 open, the bottom valve 35 permits lift gas to flow into the upper end of the production chamber 22 around the dip the 140 at a sufficiently rapid rate to effect a piston-like downward displacement of the power fluid in the production chamber 22 and upwardly through the open lower end of the dip tube 140 through the check valve 141 into the lower end of the tubing string 31 through which the power fluid returns to the surface assisted by aerating lift gas admitted through the valve 34. The check valve 142 prevents the lift gas from moving directly upwardly into the lower end of the tubing string 31 and thus confines the flow pattern of the lift gas to downward movement within the chamber 22 for the U-tube like displacement of the power fluid from the production chamber through the dip tube 140. After sufficient gas has been introduced into the production chamber to remove essentially all of the power fluid, the method steps continue as previously described repeating the cycle of again flowing formation production fluids into the production chamber and producing the fluids again by pumping in the power fluid. Thus the method of practicing the invention in the system 10A differs from the method practiced in the system 10 only in the path followed by the lift gas in displacing the power fluid from the production chamber.

The method and apparatus of the invention effectively and efficiently removes substantially more formation fluids during each production cycle than available in the prior art. By the essentially complete removal of the power fluid from the production chamber and the power fluid tubing string formation fluids flowing into the production chamber under formation pressure do not work against the back pressure of a lengthy column of power fluid as in the prior art. In typical previous examples discussed where diesel oil is employed as the power fluid to produce heavy crude oil, in the prior art each production chamber of heavy crude contained only about 3.81 barrels of crude oil in the prior art techniques while using the present apparatus and method an approximate tenfold increase in production of crude oil as obtained inasmuch probably 37.8 barrels of crude oil was produced from the production chamber during each cycle of operation.

While a particular arrangement of gas lift valves and operation of such valves to remove the power fluid has been described and illustrated, it will be recognized by those skilled in the gas lift art that other apparatus combinations and techniques of gas lift may be used to remove the power fluid from the production chamber back to the surface. In the event that it is not desired to introduce any of the lift gas into the formation fluids, the dip tube is run only to a depth at which it will always be above the maximum fill-in level or always within the power fluid in the chamber. If gas contamination of the formation fluids is not a consideration, a check valve may be placed in the lower end of the dip tube to prevent formation fluids entering the dip tube and the power fluid unloaded to the top of the formation fluid in the chamber.

What is claimed is:

1. A system for producing fluids from an earth formation through a well comprising: a production chamber in said well communicating with said earth formation; means for flow of fluids under formation pressure from said earth formation into said production chamber; a production tubing string in said well extending into commuication with said production chamber; a power fluid tubing string in said well opening at a lower end into the upper end of said production chamber; a lift gas chamber along said well around said power fluid tubing string; gas lift valves connected in spaced relation along said power fluid tubing string to admit lift gas to said power fluid tubing string from said lift gas chamber; and means connected with the lowermost gas lift valve and lower end of said power fluid tubing string to direct lift gas from said lowermost gas lift valve into said production chamber to displace power fluid from said production chamber into said power fluid tubing string.

2. A system in accordance with claim 1 wherein said lowermost gas lift valve and the one of said gas lift valves immediately above said lowermost gas lift valve are structured to function simultaneously for effecting a piston-like displacement of power fluid from said production chamber into the lower end of said power fluid tubing string and thereafter aerating power fluid in said power fluid tubing string.

3. A system in accordance with claim 2 wherein said lowermost gas lift valve has a greater flow capacity than the remainder of said gas lift valves along said power fluid tubing string.

4. A system in accordance with claim 3 including spaced upper and lower packers set in said well defining said production chamber along said well between said packers, said lower packer being above passage means leading to said earth formation, said production tubing string being connected through both of said packers and having port means for admitting formation fluids to said production chamber and check valve means for preventing backflow of fluids from said production chamber toward said earth formation and backflow of formation fluids from said production tubing string above said production chamber into said production chamber, and said power fluid tubing string opens into the upper end of said production chamber.

5. A system in accordance with claim 4 wherein the distance between said packers is substantially equal to the height of a column of formation fluid displaceable by the pressure in said formation into said production chamber.

6. A system in accordance with claim 5 including an exhaust valve in said power fluid tubing string at the surface end of said well.

7. A system in accordance with claim 6 including means connected with said power fluid tubing string for pumping power fluid into said tubing string, means connected to said power fluid tubing string for receiving returning power fluid and lift gas from said tubing string, and means connected with said well for introducing lift gas into said well and directing said lift gas to said gas lift valves.

8. A system in accordance with any one of claims 1, 2, 3, 4, 5, 6, or 7, wherein said means to direct lift gas into said production chamber comprises a dip tube connected with said lowermost gas lift valve extending to a lower portion of said production chamber to direct lift gas into said lower portion of said production chamber to displace power fluid from said production chamber upwardly into the lower end of said power fluid tubing.

9. A system in accordance with any one of claims 1, 2, 3, 4, 5, 6, or 7, wherein said means to direct lift gas into said production chamber comprises a dip tube connected into the lower end of said power fluid tubing and extending into a lower end portion of said production chamber; a check valve in said dip tube allowing only upward flow through said dip tube into said power fluid tubing for directing power fluid from said production chamber into said tubing; a check valve between the upper end of said production chamber and the lower end of said power fluid tubing allowing only downward flow from said power fluid tubing into said production chamber to permit power fluid to be pumped downwardly into said production chamber from said power fluid tubing; and flow passage means from said lowermost gas lift valve into the upper end of said production chamber for directing lift gas into said upper end of said production chamber to displace power fluid downwardly in said production chamber into said dip tube.

* * * * *